US011767209B1

(12) United States Patent
Speed

(10) Patent No.: US 11,767,209 B1
(45) Date of Patent: Sep. 26, 2023

(54) LIFTING ATTACHMENT FOR FLOOR JACK

(71) Applicant: James R Speed, Meridian, MS (US)

(72) Inventor: James R Speed, Meridian, MS (US)

( * ) Notice: Subject to any disclaimer, the term of this patent is extended or adjusted under 35 U.S.C. 154(b) by 0 days.

(21) Appl. No.: 17/826,425

(22) Filed: May 27, 2022

(51) Int. Cl.
*B66F 13/00* (2006.01)
*B66F 5/00* (2006.01)

(52) U.S. Cl.
CPC ..... *B66F 13/00* (2013.01); *B66F 5/00* (2013.01); *B66F 2700/123* (2013.01)

(58) Field of Classification Search
CPC .... B66F 13/00; B66F 5/00; B66F 5/04; B66F 7/28
See application file for complete search history.

(56) References Cited

U.S. PATENT DOCUMENTS 2,536,550 A * 1/1951 Hughes ..... B66F 5/00 254/133 R
2,747,837 A * 5/1956 Turner ..... B66F 5/00 254/DIG. 16
2,748,459 A * 6/1956 Orr ..... B25H 1/0007 269/296
2,962,262 A * 11/1960 Garver ..... B66F 5/00 254/134
3,892,385 A * 7/1975 Andrist ..... B66F 5/00 254/133 R
4,210,314 A 7/1980 Carroll et al.
4,640,495 A * 2/1987 Parsons ..... B66F 5/04 254/8 B
4,899,985 A * 2/1990 Good ..... B66F 5/04 254/8 B
5,769,357 A 6/1998 Mein
5,984,616 A * 11/1999 Youmans ..... B60P 3/125 414/226.04
6,382,644 B1 * 5/2002 Rawlings ..... B60B 29/002 414/427
6,416,039 B1 7/2002 Pietrusynski
6,427,979 B1 * 8/2002 Vogt ..... B66F 5/04 254/133 R
7,740,439 B1 * 6/2010 Browning ..... B66F 3/00 414/428
8,448,921 B2 5/2013 Hernandez
9,079,753 B2 * 7/2015 Kosjer ..... B66F 7/28
2002/0139965 A1 * 10/2002 Brackett ..... B66F 5/00 254/134
2013/0248784 A1 9/2013 Rose
2015/0307335 A1 * 10/2015 Beebe ..... B66F 7/0625 254/93 A
2019/0382251 A1 12/2019 Maslowski

* cited by examiner

*Primary Examiner* — Seahee Hong
(74) *Attorney, Agent, or Firm* — George L Williamson

(57) ABSTRACT

Method and apparatus for an adapter designed to be placed onto the upper portion of the saddle of a floor jack or other related lifting device. The adapter has two forwardly extending lifting arms thereon which lifting arms can be placed underneath a wheel so as to lift the wheel of the vehicle or related device such as a motorcycle. The adapter is designed to have left and right, angle iron frame members such that the inwardly extending flanges of the angel iron frame members receive and cradle the saddle of the floor jack therein. The adapter has front and rear locking rods which are used to lock the adapter onto the upper surface of the saddle of the floor jack. A plurality of apertures are provided in the adapter for adjusting the width of the locking rods so that the adapter can be used with a variety of sizes of saddles of the floor jack.

20 Claims, 2 Drawing Sheets

LIFTING ATTACHMENT FOR FLOOR JACK

BACKGROUND OF THE INVENTION

Field of the Invention

The present invention relates generally to floor jacks and related lifting devices, and more particularly, is concerned with an adapter for attachment to the saddle of the floor jack or on lifting device for lifting the wheel of a vehicle or like device.

Description of the Related Art

Devices relevant to the present invention have been described in the related art; however, none of the related art devices disclose the unique features of the present invention.

In U.S. Pat. No. 5,769,397 dated Jun. 23, 1998, Dhein disclosed a vehicle lifter attachment. In U.S. Patent Application Publication No. 2013/0248784 dated Sep. 26, 2013, Rose disclosed an accessory kit apparatus and method for one or more heavy duty floor jacks. In U.S. Pat. No. 6,416,039 dated Jul. 9, 2002, Pietrusynski disclosed a hydraulic floor jack with stabilizing structure. In U.S. Patent Application Publication No. 2019/0382251 dated Dec. 19, 2019, Maslowski disclosed a C-shaped jack. In U.S. Pat. No. 4,210,314 dated Jul. 1, 1980, Carroll, et al., disclosed a hydraulic jack. In U.S. Pat. No. 8,448,921 dated May 28, 2013, Hernandez disclosed a jack with selectively interchangeable components.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses an adapter designed to be placed onto the upper portion of the saddle of a floor jack or other related lifting device. The adapter has two forwardly extending lifting arms thereon which lifting arms can be placed underneath a wheel so as to lift the wheel of the vehicle or related device such as a motorcycle. The adapter of the present invention is designed to have left and right, angle iron frame members such that the inwardly extending flanges of the angel iron frame members receive and cradle the saddle of the floor jack therein. The adapter has front and rear locking rods which are used to lock the adapter onto the upper surface of the saddle of the floor jack. A plurality of apertures are provided in the adapter for adjusting the width of the locking rods so that the adapter can be used with a variety of sizes of saddles of the floor jack.

An object of the present invention is to provide an attachment for placement onto a floor jack which adapts the floor jack to particularly lift the wheel of a vehicle or other type device. A further object of the present invention is to provide an adapter for use with a floor jack which can be used with a variety of sizes of saddles of floor jacks. A further object of the present invention is to provide an attachment for use with a floor jack which can be securely and safely attached to the saddle of a floor jack. A further object of the present invention is to provide an adapter for a floor jack which can be used to lift many different sizes of wheels. A further object of the present invention is to provide an adapter for use with a floor jack which can be easily operated by a user. A further object of the present invention is to provide an adapter for a floor jack which can be relatively economically and easily manufactured.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 2:
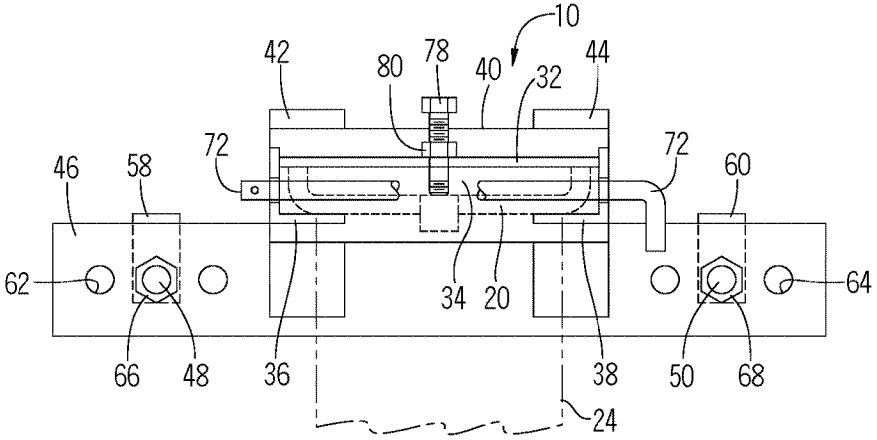
FIG. 2 is a rear elevation view of the present invention.
Figure 1:
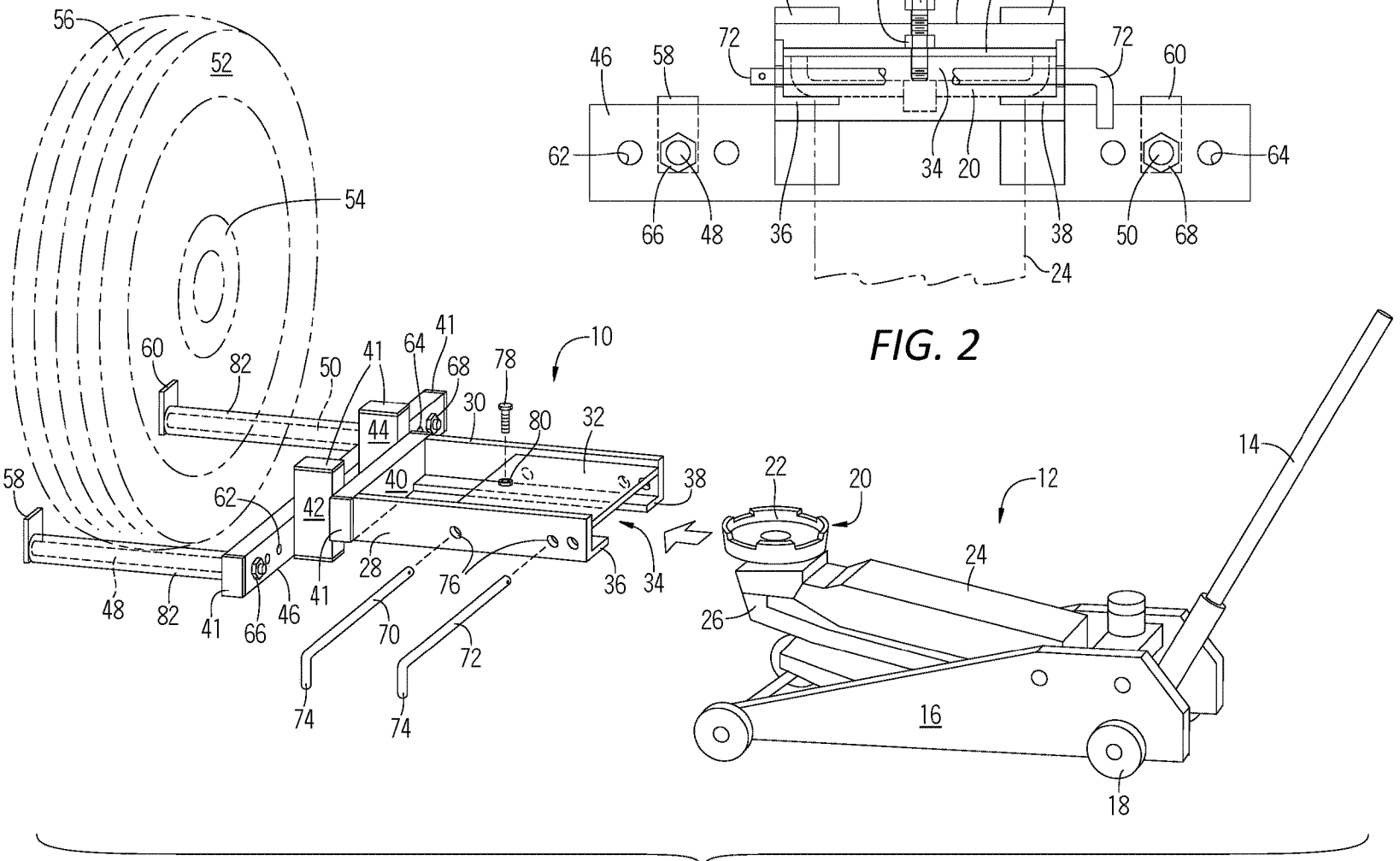
FIG. 1 is a perspective view of the present invention.
Figure 5:
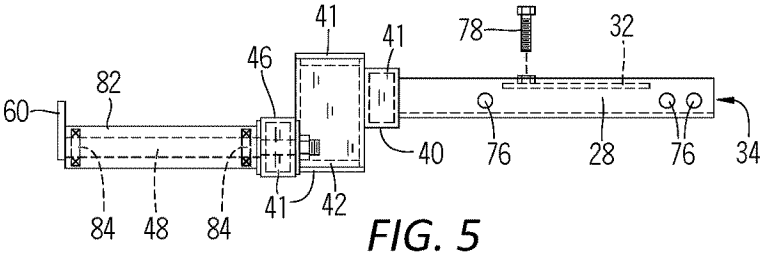
FIG. 5 is a left side elevation view of the present invention.
Figure 6:
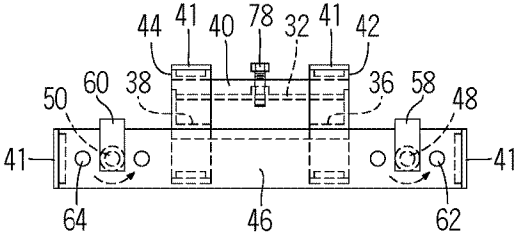
FIG. 6 is a front elevation view of the present invention.
Figure 7:
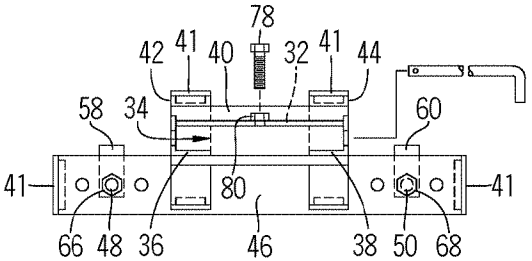
FIG. 7 is a rear elevation view of the present invention.

With regard to reference numerals used, the following numbering is used throughout the drawings.

10 present invention
12 floor jack
14 handle
16 base of frame
18 wheel
20 saddle
22 top edge of saddle
24 upper lifting arm
26 lower lifting arm
28 left angle iron frame member
30 right angle iron frame member
32 top plate
34 semi-enclosed cavity
36 left flange
38 right flange
40 front member
41 end cap
42 left upright member
44 right upright member
46 front cross member
48 left lifting arm
50 right lifting arm
52 tire
54 wheel
56 tread
58 left end cap
60 right end cap
62 left aperture
64 right aperture
66 left fastener
68 right fastener
70 front locking rod
72 rear locking rod
73 cotter pin
74 handle
76 aperture
78 locking screw
80 nut
82 outer tube
84 roller bearing
86 washer

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 8 illustrate the present invention wherein an adapter for use with a floor jack is disclosed and which is generally indicated by reference number 10.

Turning to FIGS. 1-8, therein is shown the present invention 10 proximate to a floor jack 12 or related device having a handle 14 thereon along with a supporting frame member having a base 16 supported on a plurality of ground contacting wheels 18 which allow the floor jack 12 to be rolled about upon a supporting surface such as a floor along with a saddle 20 having a top edge 22 thereon disposed on an upper lifting arm 24 and a lower lifting arm 26. The present invention 10 provides an adapter for placement onto the saddle 20 of the floor jack 12 wherein the adapter 10 has a left and right angle iron frame member 28, 30 generally forming a left and right wall of the adapter 10 having a top plate 32 which extends across an upper surface joining the left and right angle iron frame members 28, 30 together so that a semi-enclosed cavity 34 is formed between the left and right angle iron frame members for receiving the saddle 20 of the floor jack 12 therein. The adapter 10 also comprises left and right flanges, 36, 38 and it should be clear that the left and right angle iron frame members may be formed from sections of angle iron or the like which provide the left and right flanges 36, 38. A front member 40 is provided on the front of the left and right angle iron frame members 28, 20 for attachment to left and right upright members 42, 44 which are used for joining the frame members 28, 30 to the front cross member 46 to which cross member are attached the left and right lifting arms, 48, 50. The left and right lifting arms 48, 50 are used for placement underneath the tire 52 which is secured on a wheel 54 in the standard manner wherein the lifting arms 48, 50 make direct contact with the tread 56 of the tire so that the tire and wheel assembly can be lifted by the adapter 10. Also shown are left and right end caps 58, 60 which are placed on the ends of the corresponding left and right lifting arms 48, 50 to prevent the tire 52 from sliding off of the left and right lifting arms 48 50. A plurality of left and right apertures 62, 64 are also provided for receiving the rear ends of the left and right lifting arms 48, 50 so that the horizontal distance between the left and right lifting arms can be adjusted for accommodating different sizes of tires 52 and wheels 54. Also shown are left and right fasteners 66, 68 for joining the left and right lifting arms 48, 50 to the front cross member 46. It should be noted that the left and right lifting arms 48, 50 each have a rotational component about their central axis so that the wheel 54 can be rotated while being supported by the left and right lifting arms 48, 50; this rotational feature is shown by the arrows drawn about each of the left and right lifting arms (See FIG. 6). Also shown are front and rear 70, 72 locking rods each having a handle 74 thereon which locking rods can be placed in a user selectable series of apertures 76 disposed on the left and right angle iron frame members 28, 30 so as to capture the front and rear edges of the saddle 20 therein between the locking rods so that the saddle is firmly and securely removably held inside the adapter 10 of the present invention. Also shown is a locking screw 78 disposed in a threaded throughbore in the top plate 32 so that the tip of screw 78 can be adjustably tightened to contact and additionally secure the saddle 20 to the adapter 10 of the present invention. A nut 80 (See FIG. 2) having mating threads may be used to fasten the screw 78 to the top plate 32. Due to the fact that the front member 40, the left and right upright number 42, 44, and the front cross member 46 may be made of either round, square, or rectangular hollow tubing being open on its ends an end cap 41 is shown on the ends of each of these members.

Figure 8:
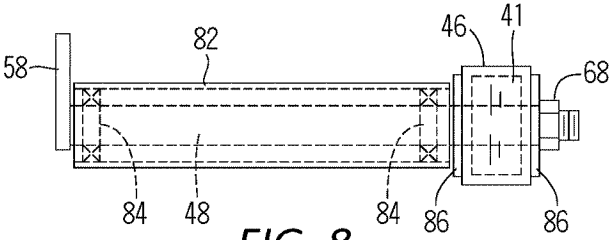
FIG. 8 is a side elevation view of a portion of the present invention.
Figure 3:
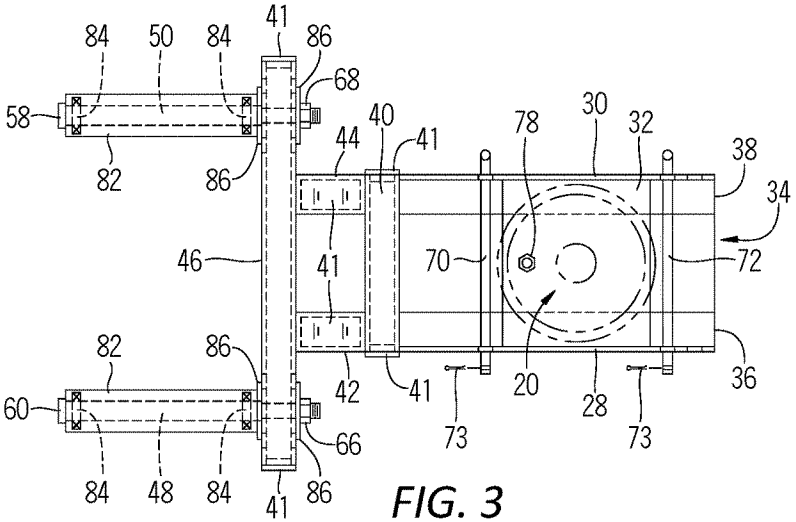
FIG. 3 is a plan view of the present invention.
Figure 4:
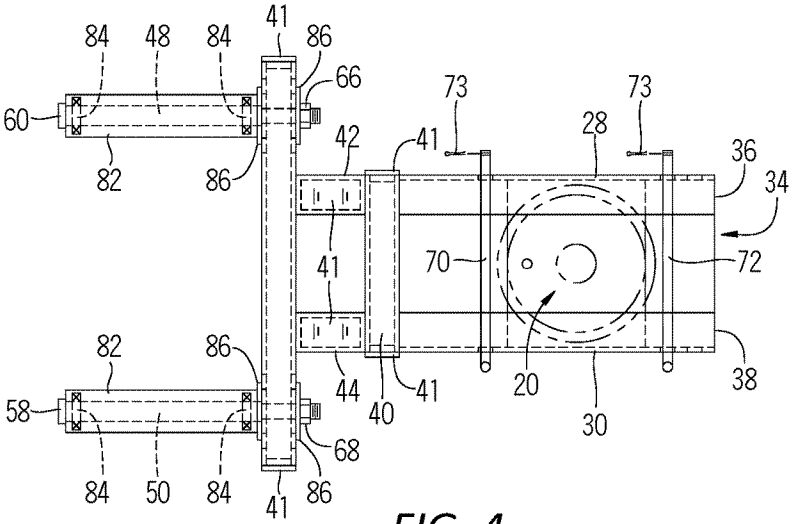
FIG. 4 is a bottom view of the present invention.

Turning to FIG. 8, therein is shown the left lifting arm 48 having a rotating outer tube 82 thereon which outer tube rotates on front and rear roller bearings 84 so that when the lifting arm 48 is placed underneath a wheel 54 the wheel can be rotated on the rotating outer tubes when in a position of being supported such as shown in FIG. 2. Also shown is the front cross member 46 and an end cap 41 along with end cap 58 on the left lifting arm 48. Also shown are a pair of washes 86 as would be used in the conventional manner to help in attaching the lifting arm 48 to the front cross member 46.

Left and right side designations regarding the present invention 10 are interpreted from the view of one standing at the handle 14 and facing forwardly, i.e., toward the tire 56. Also, lines with arrowheads are sometimes placed on drawings to indicate potential motion or direction of movement of an item illustrated in the drawing.

I claim:

1. An adapter for attachment to a saddle of a lifting device for lifting a wheel of a vehicle, comprising:

(a) a semi-enclosed receptacle with a rear opening for horizontally receiving the saddle therein, said receptacle defined by a top plate, left and right side members, left and right lower members and a front member disposed on a front end of said receptacle, extending from said left side member to said right side member, said rear opening being at an opposite end of said receptacle from said front member, and being large enough for receiving said saddle;

(b) a front locking member for removably securing the adapter to a front portion of the saddle and a rear locking member for removably securing the adapter to a rear portion of the saddle when said saddle is within said receptacle;

(c) left and right lifting arms disposed on said front member for contacting and lifting the wheel of the vehicle; and (d) whereas said saddle slides horizontally into said adapter when required for lifting said wheel and out of said adapter when not required for lifting said wheel.

2. The adapter of claim 1, wherein the distance between said front and rear locking members is adjustable.

3. The adapter of claim 1, wherein the distance between said left and right lifting arms is adjustable.

4. The adapter of claim 1, wherein said left side member and said left lower member is made of a single piece of angle iron.

5. The adapter of claim 1, wherein said right side member and said right lower member is made of a single piece of angle iron.

6. The adapter of claim 1, further comprising a locking screw for securing said top plate to an upper surface of the saddle.

7. The adapter of claim 1, wherein said top plate rests on an upper surface of the saddle.

8. The adapter of claim 1, wherein said left and right lower members support an underside of the saddle.

9. The adapter of claim 1, wherein each said left and right lifting arm comprises a component which is rotatable about its longitudinal central axis to allow for rotation of said wheel while in contact with said left and right lifting arms.

10. The adapter of claim 1, in which said vehicle is a motorcycle.

11. A method of making and using an adapter for attachment to a saddle of a lifting device for lifting a wheel of a vehicle, comprising the steps of:

(a) providing a semi-enclosed receptacle for receiving the saddle therein, the receptacle defined by a top plate, left and right side members, left and right lower members and a front member disposed on a front end of the left and right side member, and a rear opening for receiving said saddle;

(b) using a front locking member for removably securing the adapter to a front portion of the saddle and a rear locking member for removably securing the adapter to a rear portion of the saddle when said saddle is within said receptacle;

(c) disposing left and right lifting arms on the front member for contacting the wheel of the vehicle; and (d) sliding said saddle horizontally into said adapter through said rear opening when required for lifting said wheel and out of said adapter when not required for lifting said wheel.

12. The method of claim 11, wherein the distance between the front and rear locking members is adjustable.

13. The method of claim 11, wherein the distance between the left and right lifting arms is adjustable.

14. The method of claim 11, wherein the left side member and the left lower member is made of a single piece of angle iron.

15. The method of claim 11, wherein the right side member and the right lower member is made of a single piece of angle iron.

16. The method of claim 11, further comprising the step of providing a locking screw for securing the top plate to an upper surface of the saddle.

17. The method of claim 11, wherein the top plate rests on an upper surface of the saddle.

18. The method of claim 11, wherein the left and right lower members support an underside of the saddle.

19. The method of claim 11, further comprising the step of rotating the wheel while being supported on each left and right lifting arm.

20. The method of claim 11, in which said vehicle is a motorcycle.

* * * * *